US005351517A

United States Patent [19]

Späth

[11] Patent Number: 5,351,517

[45] Date of Patent: Oct. 4, 1994

[54] METHOD OF, AND A MACHINE FOR, STRETCHING AND BENDING A PROFILED LENGTH OF MATERIAL

[76] Inventor: Walter Späth, Hardstrasse 8, 7705 Steisslingen, Fed. Rep. of Germany

[21] Appl. No.: 929,165

[22] Filed: Aug. 11, 1992

[30] Foreign Application Priority Data

Dec. 10, 1991 [DE] Fed. Rep. of Germany ..... 4140591

[51] Int. Cl.[5] ..... B21D 11/02

[52] U.S. Cl. ..... 72/297; 72/301

[58] Field of Search ..... 72/295–298, 72/301, 302, 150, 151

[56] References Cited

U.S. PATENT DOCUMENTS

| | | | |
|---|---|---|---|
| 3,426,569 | 2/1969 | Brauer | 72/295 |
| 3,948,071 | 4/1976 | Lieberman | 72/296 |
| 4,481,803 | 11/1984 | Dieser | 72/150 |
| 4,827,753 | 5/1989 | Moroney | 72/296 |

FOREIGN PATENT DOCUMENTS

| | | | |
|---|---|---|---|
| 0264082 | 4/1988 | European Pat. Off. . | |
| 3627152 | 12/1987 | Fed. Rep. of Germany . | |
| 271014 | 10/1989 | Japan | 72/296 |
| 171560 | 11/1921 | United Kingdom | 72/298 |

OTHER PUBLICATIONS

Stretch-wrap forming, In: Machinery and Production Engineering, Jun. 7, 1972, S.798–801.

*Primary Examiner*—Daniel C. Crane

*Attorney, Agent, or Firm*—Lackenbach Siegel Marzullo Aronson & Greenspan

[57] ABSTRACT

A method of stretching and bending hollow profiled lengths of material provides for the hollow profiled length to be bent symmetrically from both ends, starting from the ends of the length of material, simultaneously in a Y torsion direction under initial tension. Respective tools for bending the length of material are stationary and the hollow profiled length of material is bent in the torsion direction by means of a movable clamping head about the bending tool. The clamping head is also pivotable in the torsion direction. Alternatively, the hollow profiled length of material can also be bent about a bending template. The hollow profiled length of material is wound onto core tools from its ends and a pressing die acts on the hollow profiled length between the core tools.

9 Claims, 6 Drawing Sheets

METHOD OF, AND A MACHINE FOR, STRETCHING AND BENDING A PROFILED LENGTH OF MATERIAL

FIELD OF THE INVENTION

This invention relates to a method of, and a machine for, stretching and bending a profiled length of material, wherein said length of material to be bent is clamped on both sides thereof with its longitudinal edge contacting either a supporting point or a supporting rail.

BACKGROUND OF THE INVENTION

A method of this kind is used to a large extent in the automobile accessory industry, where trim strips, window frames and like narrow, and more particularly open, profiled lengths of material which are relatively easy to bend are manufactured.

Such a method is not, however, suitable for stretching and bending closed hollow profiled lengths or half-open profiled lengths of intricate cross-section, because the hollow profiled length is not supported in such a way as to avoid some undesired deformation of the profiled length.

Although this problem can be solved by filling the hollow profiled length with sand where only small batches are to be produced, large batches cannot be produced in this way.

Pipes having relatively thin walls can be bent by means of pipe stretching and bending machines, wherein the pipe to be bent is filled with a mandrel. The mandrel consists of two parts, namely a relatively rigid mandrel shaft which is introduced into the pipe, and a sectional mandrel comprising individual sections pivotably connected to each other and joined together in the form of a chain.

Nevertheless, the two ends of an open-ended pipe, cannot, by the use of such means, be bent symmetrically in the same operation and at the same time. The manner in which the sectional mandrel is pulled through the pipe prevents the sectional mandrel from being inserted from both ends of the pipe simultaneously. The mandrel shaft is kept stationary during the bending process.

Instead of a two-part mandrel, a continuous sectional mandrel may be used, which remains stationary during the bending process. The pipe is moved during the bending operation, whilst the mandrel remains stationary, because the pipe is pulled around a bending tool. The pipe is in practice pulled over the stationary mandrel.

A disadvantage of this method, is that a bending contour cannot be applied to an open-ended pipe from both ends simultaneously and in the same operation, because the pipe is moved around the bending tool.

SUMMARY OF THE INVENTION

It is, therefore, an object of the invention to provide a stretching and bending method in which in one and the same operation, a hollow profiled length of material can be bent from both sides symmetrically or asymmetrically, and simultaneously.

The present invention consists in a method of stretching and bending hollow profiled lengths of material wherein the length to be bent is clamped on both sides and at the same time is supported at its longitudinal edge and in connection with a bending process in the X-Y direction there is arranged in the interior of the hollow profile, a mandrel shaft with a sectional mandrel attached thereto, wherein the sectional mandrel is pulled through the hollow profiled length during the bending process, characterised in that the hollow profiled length is bent symmetrically from both sides from the ends simultaneously in the X-Y torsion direction under initial tension, wherein the hollow profiled length and a bending tool are stationary during the bending process and the hollow profiled length is bent in the X-Y direction with a movable clamping point about the stationary bending tool and wherein the clamping point, apart from the X-Y direction, in addition pivots about a pivot point in the Z-direction on the clamping head.

In a first embodiment of the invention a bending station is arranged at at least one end of the hollow profiled length, and said length is placed under initial tension. The initial tension can be applied to the profiled length because it is clamped at each end in a clamping head and the clamping heads are operated in opposite directions with respect to each other by means of hydraulic cylinders. In another embodiment the hollow profiled length is pressed by means of a clamping jaw against a rotatably driven bending tool, rotation of the bending tool producing the initial tension necessary to deform said profiled length in the direction of its longitudinal axis.

In the first embodiment, the profiled length is wound around a bending tool which is constructed as a core, which is stationary, while in the second embodiment the profiled length is attached by means of clamps to the bending tool. With the profiled length stationary, the bending tool winds itself along the profiled length, so that it is wound around the bending tool, in effect a winding tool, which rotates and moves in the direction of the longitudinal axis of the profiled length of material.

In the first embodiment, therefore, the bending tool is stationary and the profiled length is wound around the stationary bending tool, while in the second embodiment the profiled length is also stationary, but is at the same time wound around a winding tool which moves in the direction of the longitudinal axis of the profiled length. The "winding tool" may be referred to as a "core tool".

With both methods, a hollow profiled length of material can be bent from both ends inversely symmetrically without undesired deformation, in large-scale production. In the known methods the profiled length had to be unclamped and then bent from the other end. Because the hollow profiled length was moved, therefore, successive bending of both ends thereof was required.

According to the methods of the invention, the hollow profiled length is held fast, and the bending stations, which operate specially according to the two embodiments described above, bend the two ends of the hollow profile symmetrically and simultaneously in the same operation.

A prerequisite for the methods of the two embodiments described above is that the interior of the hollow profiled length is supported during bending, in order to prevent deformation thereof, for example by collapse, creasing, bulging and the like.

The hollow profiled length of material may consist of a single hollow chamber, or may comprise several hollow chambers which may have different cross-sections. Also the hollow profiled length may be partially open and may comprise partially closed and partially half-open chambers.

Where said profiled length comprises a plurality of chambers all the chambers must be filled by a mandrel, which may consist of a plurality parts. This mandrel is either constructed as a sectional mandrel over its whole length or it may be a two-part mandrel consisting of a fixed mandrel shaft, the front end of which is adjoined by a sectional mandrel.

The sectional mandrel consists, of several sectional elements joined together in the manner of chain links.

The mandrel may, therefore, be according to three different embodiments.

A two-part mandrel consisting of a mandrel shaft and an adjoining sectional mandrel can be used in both of the methods described above, there being a stationary bending tool around which the hollow profiled length of material is bent.

In the method according to the second embodiment in which a core tool is driven movably lengthwise of the longitudinal axis of the hollow profiled length a one-part continuous sectional mandrel, may be used.

In the embodiment first described, the mandrel performs a pulling movement in relation to the hollow profiled length to be bent, this being that it is always ensured that the connecting region between the mandrel shaft and the optionally adjoining sectional mandrel is located at the bending point.

That end of the mandrel shaft which adjoins the sectional mandrel, if provided, must, therefore, always be located at the bending point of the hollow profiled length so that when the hollow profiled length is bent round on the bending tool, the said end of the mandrel shaft performs a longitudinal movement in the direction of the longitudinal axis of the hollow profiled length in order to fulfil the condition that at least said end of the mandrel shaft is always located at the bending point of said length. The sectional mandrel must be withdrawn slowly during the bending process in a movement relative to the rotary movement of the tool, so that the uniformity of the cross-section of said profiled length is preserved.

It is thus ensured that at the critical bending point, at which undesired deformation of said profiled length would otherwise take place, such undesired deformation is avoided by the presence of said end of the mandrel shaft. Said end of the mandrel shaft is not shaped during the bending process.

That is to say the whole of the respective end at which the profiled length is clamped by means of a clamping head is moved around the bending tool, in order to achieve the required bending radius.

Although the clamping head described in detail below may comprise a column, a carriage slidable thereon and holders which are rotatably mounted thereon and against which the clamping head abuts, other mechanisms may be used such as a hydraulically pivotable arm against an end of which the clamping head abuts.

In a machine according to the invention a bending station is provided at each end of the profiled length of material. The bending stations operate simultaneously and thus produce the required bending radii in a single operation.

Since in each embodiment both of the bending stations are identical, only the operation of a single bending station of each embodiment will be described herein.

The clamping head is mounted for rotation on its holder, in order to be able in addition to impart torsion to the hollow profiled length of material to be bent.

Similarly, the hollow profiled length which is to be bent and which lies undeformed in the X-plane can be bent not only in the Y-plane, but also in the Z-plane. By virtue of the corresponding capacity for three-dimensional movement of the clamping head, which in the embodiment under discussion is then movable not only in the X-Y direction, but also in the Z-direction, a three-dimensional stretching and bending of the profiled length can be achieved. The possibility of achieving a three-dimensional stretching and bending method also arises in the second embodiment to be described below, in which the core tool moves along the longitudinal axis of the hollow profiled length to be bent and is also driven in rotation. The core tool may be arranged so that it can move in three dimensions, in order on the one hand to impart additional torsion to the hollow profiled length and on the other hand to bend it in three different spatial directions.

A characteristic of both embodiments is that the hollow profiled length of material is stationary and identical bending stations are provided at the ends of said length so that the required bending operations can be performed on the hollow profiled length in one and the same operation simultaneously.

The bending tools and core tools described herein in respect of the different embodiments may be other than circular. Desired curves can be imparted to the profiled length by means of bending tools or core tools of different shapes, the tool being oval for example.

Such large scale operations are of particular use in bending bumpers in the automotive industry or hoops in goods wagon construction and wherever symmetrical contours are to be produced on a large scale. Such shaped profiled lengths of material may be employed in cell structures for motor vehicles or aircraft frames.

DETAILED DESCRIPTION OF THE EMBODIMENTS OF THE INVENTION

Figure 1:
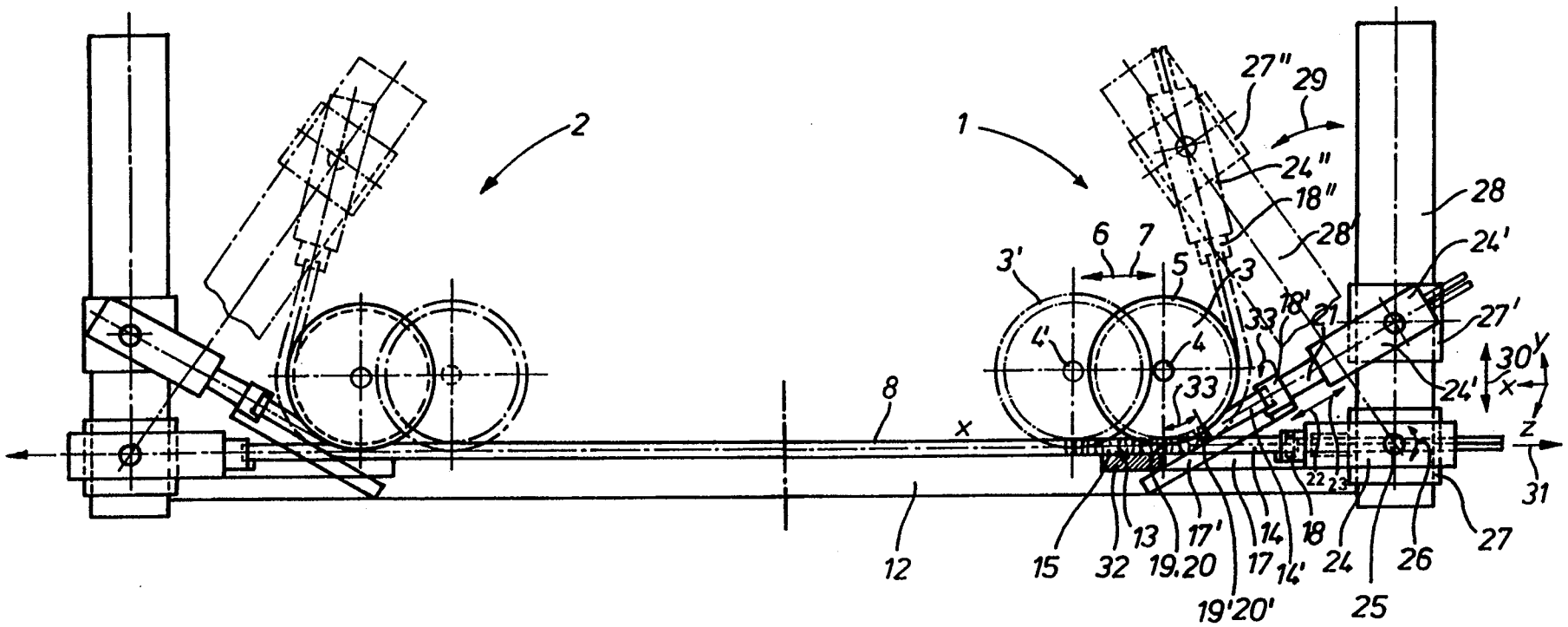
FIG. 1 is a diagrammatic side view of a stretching and bending machine according to a first embodiment of the invention for hollow profiled lengths of material.

As shown in FIG. 1, the machine according to the first embodiment comprises two bending stations 1 and 2 of identical construction and which are arranged symmetrically with respect to each other in relation to a hollow profiled length 8 of material to be bent. Since the bending stations 1 and 2 are of identical construction, only the bending station 1 will be described herein in detail.

The bending station 1 comprises a bending tool 3 mounted for rotation about an axis of rotation 4 on a machine frame, not shown in detail.

The bending tool 3, as indicated in broken lines at 3' is displaceable in the direction of the arrows 6,7, in order to adjust the length of the hollow profiled length 8 which is to be bent, that is to say in order to be able to bend hollow lengths 8 of different widths.

The hollow profiled length 8 is held at each end in a respective clamping head 18 at the free end of a rod 21 mounted in a holder 24 for axial displacement in the directions of arrows 22 and 23.

The holder 24 is mounted for rotation about a pivot point 25 on a carriage 27 driven in the directions of arrows 30, on a column 28.

The column 28 is in turn mounted on said machine frame for pivotal movement about a pivot point 25 in the direction of the arrow 26.

Three working steps in the bending of the profiled length 8 are indicated by respective upright lines.

In the straight, undeformed position of the length 8 a mandrel 13 engages in the hollow profile of said length, the mandrel 13 consisting of two parts namely a mandrel shaft 14 and a sectional mandrel 15 as described above, attached to one end 20 of the shaft 14. The mandrel 13 is movable axially in the direction of the arrow 31 by means of a hydraulic system not shown in detail.

In the undeformed condition of the hollow length 8, the end 20 of the shaft 14 contacts the bending tool 3 precisely at a bending point 19.

In order to prevent the hollow profiled length 8 from bulging at the bending point 19, a supporting jaw 17 on the opposite side of length 8 to the bending tool 3 securely embraces said length 8, at the bending point 19.

The supporting jaw 17 not only contacts the hollow profiled length 8 at the bending point 19, but extends over the whole length of said profiled length 8 from the bending point 19 to the clamping head 18. The front end portion of the supporting jaw 17 then terminates at the bending point 19. From the bending point 19 said length 8 is supported by a second supporting jaw 32, in order to absorb the counter-reaction of the hollow profiled length 8 during its shaping. The supporting jaws 17 and 32 are mechanically separate from each other, in that the supporting jaw 17 moves with the clamping head 18, while the supporting jaw 32 remains in the position in which it is shown in FIG. 1.

The supporting jaw 32 is therefore subjected only to a hydraulically controlled delivery force towards and away from the hollow profiled length 8 thereby ensuring that said length 8 can be fed through.

If a stationary supporting jaw 32 is used, a supporting rail 12, shown in FIG. 1, which extends over the whole length of the hollow profiled length 8 may be omitted.

If no supporting jaw 32 is provided the supporting rail 12 is used to support said length 8 on its side opposite to the bending tool 3.

In order to bend the hollow profiled length 8 an initial tension is first applied to the clamping head 18 in the direction of the arrow 31, and then the carriage 27 is raised in the direction of the arrow 30 into a position 27'. The bending point 19 is thereby moved into a position 19' and at the same time the mandrel 13 is moved in the direction of the arrow 31 by a distance 33' in order to ensure that the end 20 of mandrel shaft 14 (now at a position 20') remains at the bending point 19'. Said length 8 itself stops and only the mandrel 13 moves with the bending point 19 in arrow direction 31.

A larger bending angle can be achieved by pivoting the column 28 about the pivot point 25 and at the same time moving the carriage 27 into position 27'' and similarly moving the clamping head 18.

Thus practically any desired bending angle can be produced.

By suitably shaping the bending tool 3 and profile 5 used with the bending tool 3, any required bending radii can also be produced.

The clamping head 18 is mounted for rotation on the rod 21 and can be driven in rotation in order to impart to the hollow profiled length 8 to be bent, an additional rotary movement 33 (torsion) as indicated by the arrow 33.

The bending station 2 is of the same construction as, and operates in the same steps, as the bending station 1.

As well as being capable of bending said length 8 in direction Y, the whole assembly of the clamping head 18 is also movable in direction Z and, if occasion arises, is also rotatable (twistable), in order to ensure three-dimensional bending of the hollow profiled length 8.

Figure 2:
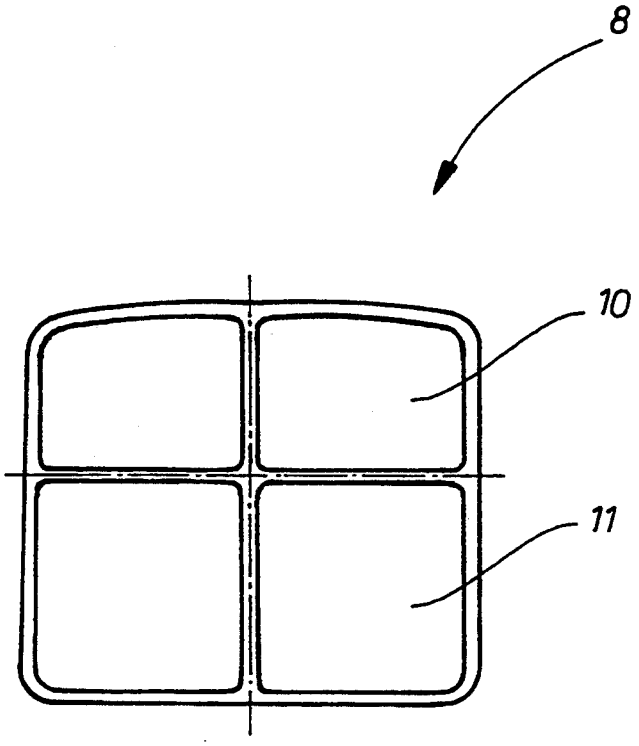
FIG. 2 is an end view of a hollow profiled length of material to be stretched and bent by means of the machine.

Where, as shown in FIG. 2, the hollow profiled length 8 of material, comprises different chambers 10 and 11 a corresponding mandrel 13 must engage in each chamber. In this case the mandrel 13 is, therefore, comprised of the appropriate number of parts.

Figure 3:
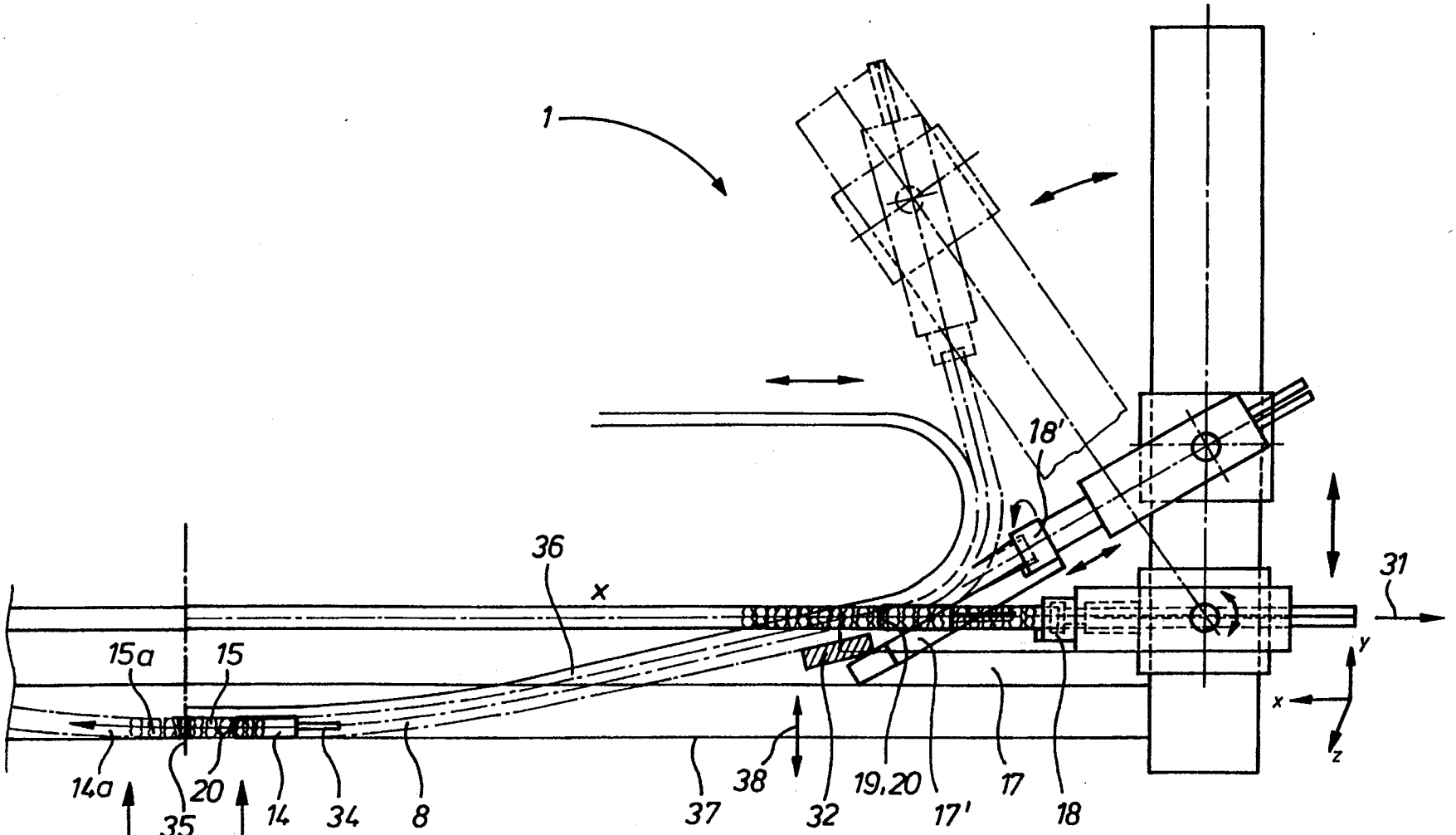
FIG. 3 is a diagrammatic side view of a stretching and bending machine for hollow profiled lengths of material according to a second embodiment of the invention.

According to the embodiment of FIG. 3, which is a modified version of the embodiment of FIG. 1, the hollow profiled length 8 can not only be bent at its ends, but along the whole of the remainder of the length 8.

In the embodiment of FIG. 3 there is provided instead of the bending tool 3 of FIG. 1, a bending template 36 fixedly mounted on a machine frame and having an outer side for engagement by the hollow profiled length 8 to be bent.

The mandrel 13, which engages in said length 8, consists of two parts as in the first embodiment namely a non-deformable mandrel shaft 14 and a sectional mandrel 15 attached to the end 20 of the shaft 14. The sectional mandrel 15 of the bending station 1 terminates at 35 exactly centrally of the hollow profiled length 8, and the mandrel **13*a* of the bending station 2, engages in said length 8 in the opposite direction to the mandrel 13. At 35, therefore, the mandrels 13 and 13*a*** almost touch each other.

At the beginning of the bending operation, the clamping head 18 is moved to the level of line 37. Initial tension, as described above with reference to FIG. 1, is then applied to the length 8 in the direction of the arrow 31. The clamping head 18 is then raised in the direction of the arrow 38, whereby the hollow profiled length 8 to be bent is applied to the bending template 36 under initial tension and at the same time the mandrel 13 is moved outwards in the direction of the arrow 31 and thus along in the interior of the stationary hollow length 8. It is provided that the end 20 of the mandrel shaft 14 always moves at the bending point. In other respects, the FIG. 3 embodiment operates in the manner described above in respect of the FIG. 1 embodiment.

In the FIG. 3 embodiment, the bending tool 3 of FIG. 1, is replaced by the stationary bending template 36. The FIG. 3 embodiment is otherwise as described above with reference to FIG. 1.

Figure 4:
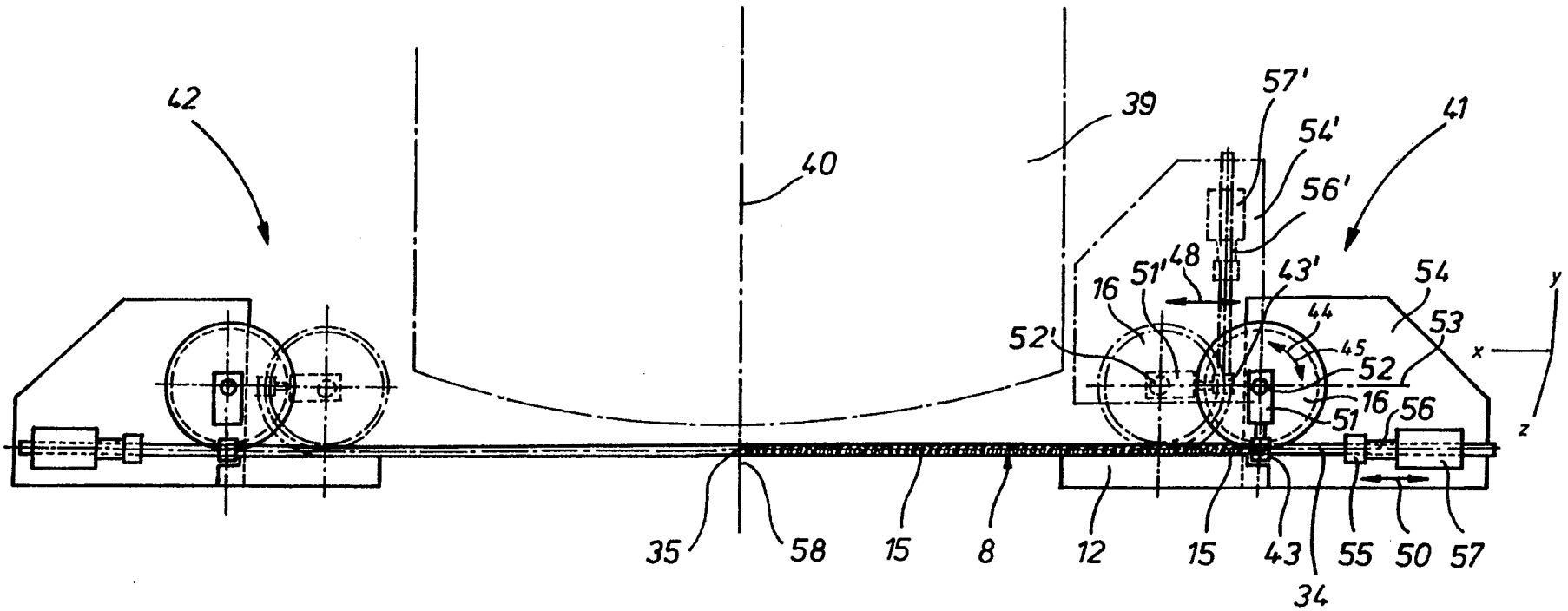
FIG. 4 is a diagrammatic side view of a stretching and bending machine according to a third embodiment of the invention, for hollow profiled lengths of material.

In the embodiment of FIG. 4 bending stations 41 and 42 are provided for deforming the length 8 to be bent, from both ends simultaneously.

In this embodiment core tools 16 of the bending stations 41 and 42 are moved along the longitudinal axis X of the length 8, the length 8 being fixed rigidly and non-displaceably by clamping jaws 43, to the outer circumference of each tool 16, so that winding of the length 8 is effected.

If, with the embodiment of FIG. 4, the length 8 must first be bent over its whole length. There is provided for this purpose a die 39 which is movable in both directions of the broken line 40. The mandrel 15 of the station 41 is advanced as far as the centre line 58, the mandrel of the bending station 42 also being advanced as far as the centre line 58, when the length 8 has been placed under initial tension produced by closing the clamping jaws 43 by means of a hydraulic device 51 and slightly tensioning the tools 16 in an anti-clockwise direction as indicated by the arrow 44.

Each mandrel in the FIG. 4 embodiment consists of a long sectional mandrel 15 arranged at the free end of the mandrel rod 34. The mandrel rod 34 is, in this embodiment, held in a mandrel holding station 55 arranged on a rod 56 which is displaceable in the direction of arrows 50 by means of a drive 57. The above components are mounted in a holder 54.

When bending the hollow profiled length 8 over the whole length thereof, the die 39 is first moved in the downward direction of the broken line 40 and onto the length 8 which is under initial tension, the shortening of the length 8 which occurs at the same time is compensated for, in that the tool 16 rotates in an counter-clockwise direction as indicated by the arrow 44 and moves along a line 53 until it reaches position 16', for example.

Simultaneously with such rotation of the tool 16, the holder 54 is pivoted in order to prevent a break point in the region of the mandrel rod 34 from forming in the region of the clamping jaws 43.

As the die 39 moves downward, therefore, the sectional mandrel 15 is first located with its end 35 in the region of the centre line 58. With increasing pivotal movement of the holder 54 in the direction of the arrow 44, and hence also with increasing rotation of the tool 16 in the direction of the arrow 44, the mandrel 15 is pulled in the right hand direction of the arrow 50, whereby the mandrel 15 supports the hollow profiled length 8 over the whole of its length that is to be bent.

During deformation of the length 8 by virtue of the downward movement of the die 39, the mandrel 15 is pulled very slowly in the right hand direction of the arrow 50 in order to prevent the individual sections from standing out at the inner circumference of the length 8 so as to cause bulging there. The mandrel 15 is thus pulled along in the individual chambers of the hollow profile in the manner of a "pipe cleaner", in a pipe stem.

The final contour, for example a 90° angle of bending, is then achieved by fully pivoting the holder 54 into its position 54', in FIG. 4. Thus the holder 54 has moved to the left on the line 53 in the direction of the arrow 48.

The parts of the bending station 42 simultaneously perform all the working steps, described above in relation to the parts of bending station 41.

If the length 8 is not to be bent over the whole of its length, the die 39 can be omitted and the mandrel 15 can accordingly be made shorter.

In the embodiment of FIG. 4, the tool 16 performs a kind of winding movement along the X-axis of the hollow profiled length 8, while in the embodiment of FIG. 1 described above, the bending tool 3 is stationary.

Figure 5:
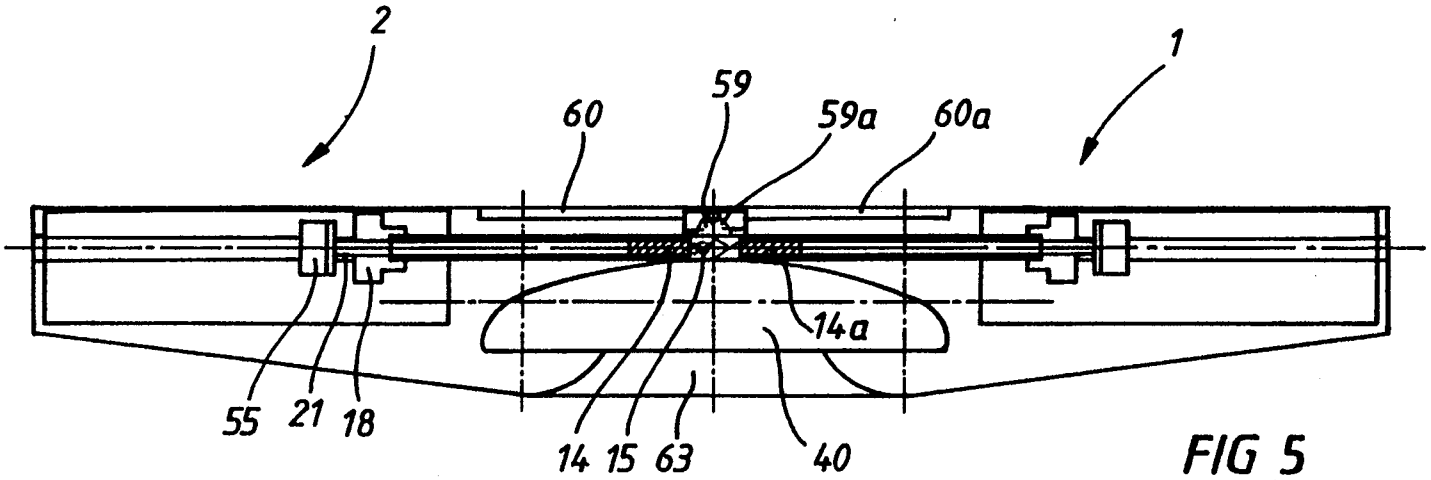
FIG. 5 is a diagrammatic side view of a modified version of a stretching and bending machine according to said embodiments at an initial stage during the bending of a hollow profiled length of material.
Figure 6:
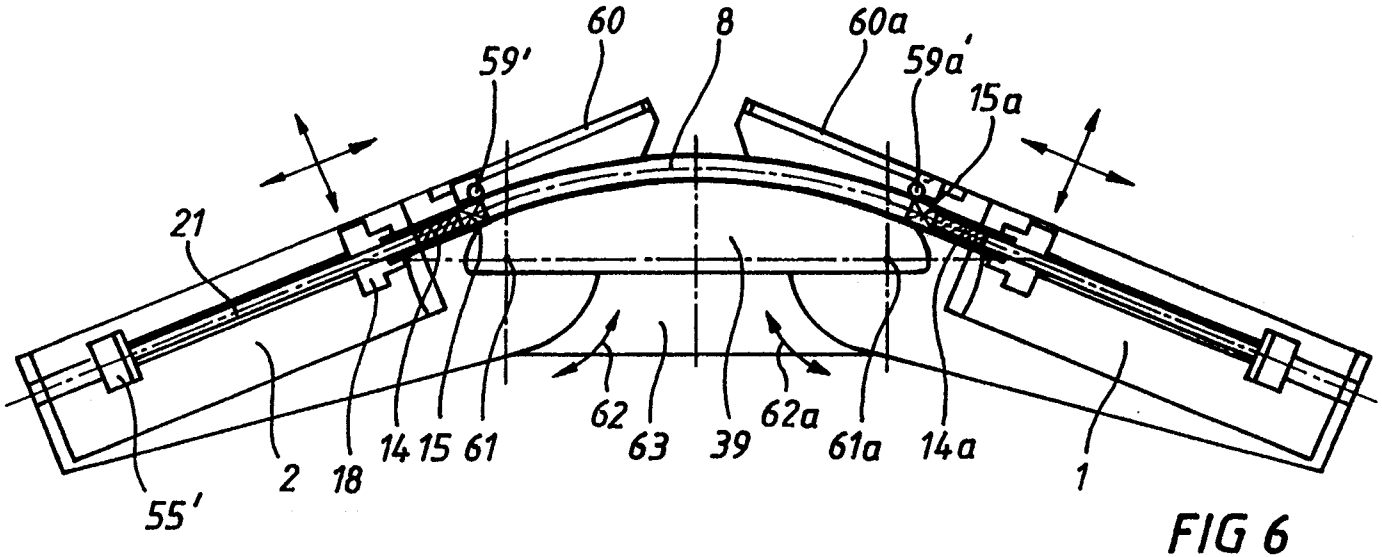
FIG. 6 is a similar view to that of FIG. 5, but showing the machine at an intermediate stage during the bending of said length.
Figure 7:
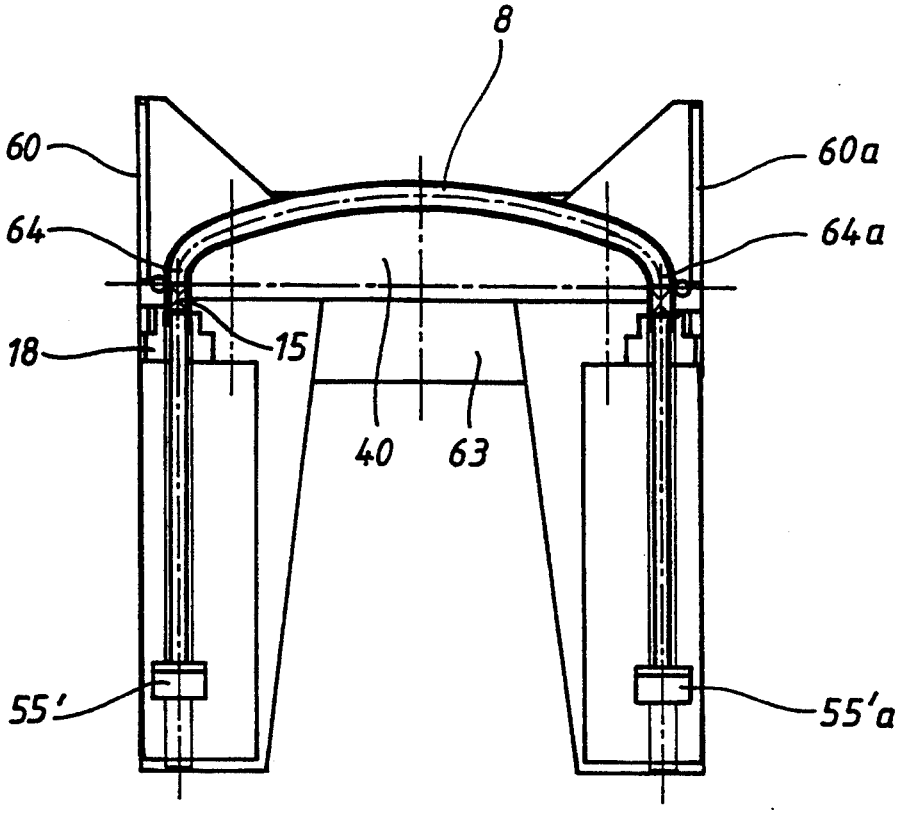
FIG. 7 is a similar view to that of FIGS. 5 and 6 but showing the machine with said length fully bent.

FIGS. 5 to 7 show a modification of the embodiments of FIGS. 1, 3 and 4, in that instead of the continuous supporting rail 12, two movable rails 60 and **60*a* are provided in the embodiment of FIGS. 5 to 7. The rails 60 and 60*a* are arranged at respective bending stations 1 and 2. Each bending station 1 and 2 is pivotably mounted at a respective pivot point 61,61*a* on a machine bed 63** and is driven in pivotal movement.

Each bending station 1 and 2 comprises a respective rail 60 or **60*a* in the region of which a respective forming roller 59 or 59*a* is driven longitudinally of the rail. At the beginning of a bending process, the bending stations 1 and 2 pivot upwards about their respective pivot points 61 and 61*a* in the directions of the respective arrows 62 and 62*a* as shown in FIG. 6. At the same time the respective forming rollers 59 and 59*a* which are displaceable along the rails 60 and 60*a* roll out on die 39, in the central region thereof, the length 8 which is to be bent. By virtue of this pressing and rolling operation in said central region the thickness of the hollow profiled length 8 which is to be bent is reduced, in order to avoid breaking the length 8 in its outer region which is subjected to the most stress. At the same time, by driving the mandrel holding stations 55 and 55*a*, the mandrels 15 and 15*a* are pulled downwards and out of the length 8 by the mandrel shafts 14 and 14*a* attached thereto. Accordingly the mandrel holding stations 55 and 55*a* are moved into their positions 55' and 55*a*', respectively. Each mandrel is, therefore, pulled backwards by its clamping head to the position of FIG. 6**.

In the FIG. 6 position, each bending station 1 and 2 is further pivoted downwards about its respective pivot point 61 or **61*a* in the direction of the respective arrow 62, 62*a* (FIG. 7). End pieces 64 and 64*a* of the length 8 are thereby finally shaped. The mandrels 15 and 15*a* must be pulled backwards by the clamping heads 18 and 18', respectively, in order to release the bent hollow profiled length 8** so that it can be removed from the bending assembly.

The length 8 shown in FIG. 2 is, for example, a bumper comprising one or more closed hollow internal profiles and being made of a light metal or any other suitable material, in which case it is important that the length 8 is bent in inverse symmetry with respect to the longitudinal central axis 40 as described above. Said closed hollow profiles are supported by the said sectional mandrels during the shaping operations and prevented from breaking during the bending process.

Bumper lengths of complicated shapes, which may comprise one or more closed hollow profiles, can accordingly be bent in a single operation, and at the same time the end pieces 64 and **64*a*** of said lengths are also formed.

What is claimed is:

1. A method of stretching and bending a hollow profiled length of material, the method comprising the steps of:

clamping each of two ends of the hollow profiled length of material by means of a clamping head and simultaneously supporting said hollow profiled length longitudinally thereof;

disposing a mandrel in the interior of said hollow profiled length;

bending said hollow length at both ends symmetrically while simultaneously tensioning said hollow length by moving the respective clamping head about a bending tool within a plane defining X-Y directions, while pulling the mandrel through said hollow length, said hollow profiled length being stationary during the bending process; and displacing said clamping head along selected X-Y directions within said plane while being pivoted about a pivot point about said bending tool.

2. A method as claimed in claim 1, further comprising the step of torsioning the hollow length during the bending step, including the steps of bending both ends of said hollow profiled length in said torsion direction and bending said hollow profiled length centrally by means of a bending template.

3. A method as claimed in 1, including the steps of clamping each end of said hollow profiled length to a respective core tool which is movable longitudinally of said hollow profiled length, and bending each end of the profiled length about said core tool in said torsion direction and pressing a die into said hollow profiled length between said core tools.

4. A machine for stretching and bending a hollow profiled length of material, the machine comprising:

first and second spaced bending stations each associated with a respective end of said hollow profiled length, said stations being symmetrically arranged;

means at each bending station for supporting said hollow profiled length longitudinally and means for simultaneously clamping it;

a mandrel at each bending station and means for inserting the mandrel into said hollow profiled length from a respective end thereof and for withdrawing said mandrel along said profiled length during bending thereof;

at least one bending tool about which the hollow profiled length can be bent within a plane defining X-Y directions at each station; and a carriage at each bending station, the carriage having a clamping head for clamping a respective end of said hollow profiled length, and for initially tensioning said hollow profiled length, the carriage being movable along selected X-Y direction within said plane in the transverse direction of said hollow profiled length and being pivotable about a pivot point in à direction which is transverse to said transverse direction, whereby said hollow profiled length is bent about said bending tool.

5. A machine as claimed in claim 4, wherein each bending station comprises a supporting rail for supporting said hollow profiled length at said at least one bending tool, before a bending point thereon for said hollow profiled length.

6. A machine as claimed in claim 4, wherein said at least one bending tool is a bending template which is common to and situated substantially centrally between said bending stations.

7. A machine as claimed in claim 4, wherein each bending station comprises a core tool and means for clamping a respective end of said hollow profiled length to the core tool, the core tools being rotatable to bend the ends of said hollow profiled length about said core tools, the machine further comprising a die which is movable between said core tools and against said hollow profiled length.

8. A method of stretching and bending a hollow profiled length of material, the method comprising the steps of:

clamping each of two ends of the hollow profiled length of material by means of a clamping head and simultaneously supporting said hollow profiled length longitudinally thereof;

disposing a mandrel in the interior of said hollow profiled length;

bending said hollow length from both ends symmetrically and simultaneously, each in a torsion direction and under initial tension, by moving the respective clamping head about a bending tool while pulling the mandrel through said hollow length, said hollow profiled length being stationary during the bending process, and said clamping head being pivoted about a pivot point in a second direction about said bending tool;

clamping each end of said hollow profiled length to a respective core tool which is movable longitudinally of said hollow profiled length; and bending said end about said core tool in said torsion direction and pressing a die into said hollow profiled length between said core tools.

9. A machine for stretching and bending a hollow profiled length of material, the machine comprising:

first and second spaced bending stations each associated with a respective end of said hollow profiled length, said stations being symmetrically arranged;

means at each bending station for supporting said hollow profiled length longitudinally and means for simultaneously clamping it;

a mandrel at each bending station and means for inserting the mandrel into said hollow profiled length from a respective end thereof and for withdrawing said mandrel along said profiled length during bending thereof;

at least one bending tool about which the hollow profiled length can be bent in a torsion direction at each station;

a carriage at each bending station, the carriage having a clamping head for clamping a respective end of said hollow profiled length and for initially tensioning said hollow profiled length, the carriage being movable in the transverse direction of said hollow profiled length and being pivotable about a pivot point in a direction which is transverse to said transverse direction, each bending station comprising a core tool and means for clamping a respective end of said hollow profiled length to the core tool, the core tools being rotatable to bending the ends of said hollow profiled length about said core tools; and a die which is movable between said core tools and against said hollow profiled length, whereby said hollow profiled length is bent about said bending tool.

* * * * *